US007776272B2

(12) United States Patent
Ekstrand et al.

(10) Patent No.: US 7,776,272 B2
(45) Date of Patent: Aug. 17, 2010

(54) LIQUID ROUTER

(75) Inventors: Gunnar Ekstrand, Uppsala (SE); Gunnar Thorsen, Hägersten (SE)

(73) Assignee: Gyros Patent AB, Uppsala (SE)

( * ) Notice: Subject to any disclaimer, the term of this patent is extended or adjusted under 35 U.S.C. 154(b) by 1303 days.

(21) Appl. No.: 10/957,452

(22) Filed: Oct. 1, 2004

(65) Prior Publication Data

US 2005/0141344 A1 Jun. 30, 2005

Related U.S. Application Data

(60) Provisional application No. 60/508,508, filed on Oct. 3, 2003.

(30) Foreign Application Priority Data

Oct. 3, 2003 (SE) ..... 0302650
Jan. 16, 2004 (SE) ..... 0400071

(51) Int. Cl.
*B01L 11/00* (2006.01)

(52) U.S. Cl. ..... 422/101; 422/103; 422/102

(58) Field of Classification Search ..... 422/101, 422/102, 103

See application file for complete search history.

(56) References Cited

U.S. PATENT DOCUMENTS 5,376,252 A 12/1994 Ekstrom
5,690,841 A 11/1997 Elderstig
5,693,233 A 12/1997 Schembri
5,773,488 A 6/1998 Allmer
5,962,081 A 10/1999 Ohman
5,995,209 A 11/1999 Ohman
6,126,765 A 10/2000 Ohman
6,144,447 A 11/2000 Ohman
6,192,768 B1 2/2001 Wallman
6,203,291 B1 3/2001 Stemme
6,322,682 B1 11/2001 Arvidsson
6,454,970 B1 9/2002 Ohman
6,620,478 B1 9/2003 Ohman (Continued)

FOREIGN PATENT DOCUMENTS

WO WO-9958245 11/1999

(Continued)

OTHER PUBLICATIONS

U.S. Appl. No. 09/937,533, Larsson et al.

(Continued)

*Primary Examiner*—Natalia Levkovich
(74) *Attorney, Agent, or Firm*—Fulbright & Jaworski LLP

(57) ABSTRACT

A liquid router that comprises an inlet microconduit that branches into two exit microconduits (microconduit I and II) and is present in a microchannel structure of a microfluidic device which is using centrifugal force created by spinning the device about a spin axis for transporting liquid. The router is characterized in comprising a microcavity in which there are: a lower part comprising two exit openings (exits I and II), and an upper part comprising an inlet opening to which the inlet microconduit (3) is connected, and microconduits I and II which are connected to exits I and II, respectively, and stretch from a shorter radial position to a larger radial position relative to the spin axis. Microconduit II has a reduced hydrophilicity (=reduced apparent wettability) compared to microconduit I.

12 Claims, 3 Drawing Sheets

U.S. PATENT DOCUMENTS

| | | | | |
|---|---|---|---|---|
| 6,632,656 | B1 | 10/2003 | Thomas | |
| 6,653,625 | B2 | 11/2003 | Andersson | |
| 6,717,136 | B2 | 4/2004 | Andersson | |
| 6,728,644 | B2 | 4/2004 | Bielik | |
| 6,811,736 | B1 | 11/2004 | Ohman | |
| 6,812,456 | B2 | 11/2004 | Andersson | |
| 6,812,457 | B2 | 11/2004 | Andersson | |
| 2002/0003001 | A1 | 1/2002 | Weigl et al. | |
| 2002/0106786 | A1* | 8/2002 | Carvalho et al. | 435/287.3 |
| 2003/0044322 | A1 | 3/2003 | Andersson | |
| 2003/0047823 | A1 | 3/2003 | Ohman | |
| 2003/0053934 | A1 | 3/2003 | Andersson | |
| 2003/0054563 | A1 | 3/2003 | Ljungstrom | |
| 2003/0082075 | A1 | 5/2003 | Agren | |
| 2003/0094502 | A1 | 5/2003 | Andersson | |
| 2003/0129360 | A1 | 7/2003 | Derand | |
| 2003/0156763 | A1 | 8/2003 | Soderman | |
| 2003/0211012 | A1 | 11/2003 | Bergstrom | |
| 2003/0213551 | A1 | 11/2003 | Derand | |
| 2003/0231312 | A1 | 12/2003 | Sjoberg | |
| 2004/0058408 | A1 | 3/2004 | Thomas | |
| 2004/0096867 | A1 | 5/2004 | Andersson | |
| 2004/0099310 | A1 | 5/2004 | Andersson | |
| 2004/0120856 | A1 | 6/2004 | Andersson | |
| 2004/0202579 | A1 | 10/2004 | Larsson | |

FOREIGN PATENT DOCUMENTS

| | | |
|---|---|---|
| WO | WO-0040750 | 7/2000 |
| WO | WO-0147638 | 7/2001 |
| WO | WO-02074438 | 9/2002 |
| WO | WO-02075775 | 9/2002 |
| WO | WO-02075776 | 9/2002 |
| WO | WO-03018198 | 3/2003 |
| WO | WO-03072252 | 9/2003 |

OTHER PUBLICATIONS

U.S. Appl. No. 10/169,056, Andersson et al.
U.S. Appl. No. 10/276,282, Larsson et al.
U.S. Appl. No. 10/402,138, Kylberg et al.
U.S. Appl. No. 09/958,577, Ulfendahl.
U.S. Appl. No. 09/869,554, Orlefors et al.
U.S. Appl. No. 09/830,475, Stjernstrom.
U.S. Appl. No. 10/168,942, Tooke et al.
U.S. Appl. No. 10/070,912, Ohman et al.
U.S. Appl. No. 10/402,137, Kylberg et al.
U.S. Appl. No. 10/030,297, Derand et al.
U.S. Appl. No. 10/924,151, Tooke et al.
U.S. Appl. No. 10/513,084, Holmquest et al.
U.S. Appl. No. 09/937,533, Derand et al.
U.S. Appl. No. 10/999,532, Ostlin et al.
U.S. Appl. No. 10/867,893, Derand et al.
U.S. Appl. No. 11/017,252, Derand et al.
U.S. Appl. No. 10/182,792, Derand et al.
U.S. Appl. No. 10/450,177, Ohman et al.
U.S. Appl. No. 10/129,032, Tormod.
U.S. Appl. No. 09/674,457, Larsson et al.
U.S. Appl. No. 10/069,827, Derand et al.
U.S. Appl. No. 10/244,667, Agren.
U.S. Appl. No. 10/849,321, Fielden et al.
U.S. Appl. No. 10/111,822, Tooke et al.

* cited by examiner

LIQUID ROUTER

CROSS-REFERENCE TO RELATED APPLICATIONS

This claims priority to U.S. Provisional Application No. 60/508,508 filed on Oct. 3, 2003, Swedish Application No. SE0302650-7, filed Oct. 3, 2003 and Swedish Application No. SE 0400071-7 filed Jan. 16, 2004.

TECHNICAL FIELD

The present invention relates to a liquid router that comprises an inlet microconduit that branches into two exit microconduits (microconduit I and II). The router is present in a microchannel structure of a microfluidic device which is using centrifugal force for transporting liquid.

BACKGROUND OF THE INVENTION

A general goal with microfluidic devices is to integrate fluidic functions for as many process steps as possible within the same microchannel structure. Integration is beneficial since it reduces time-consuming sample transfer operations as well as the risk for loss of samples and reagents, for instance. Integration may lead to a need for excluding liquids containing components that negatively affect downstream steps from the main process stream. Typical such liquids are washing liquids that may contain contaminants, and liquids that require separate processing. One way of doing this is to withdraw this kind of liquids from the main process stream/flow path of a microchannel structure. This requires simple and reliable liquid routers.

Another general goal with microfluidic devices is to perform a given process protocol with a high degree of parallelism, i.e. to have a large number of similar microchannel structures on the same device. A liquid routing function thus must be easy to reproduce between the microchannel structures.

Routing functions based on an inlet microconduit that branches into two daughter/exit microconduits and where the routing depends on a difference in surface characteristics between the daughter microconduits have previously been described in the context of centrifugally based microfluidic devices: a general description has been given in WO 02074438 (Gyros AB), which is incorporated herein by reference in its entirety; a router comprising an outwardly directed inlet microconduit, an outwardly directed exit microconduit, possible with a hydrophobized section immediately downstream the branching, and an inwardly directed exit microconduit is described in WO 0040750 (Gyros AB), WO 0147638 (Gyros AB), WO 0146465 (Gyros AB), WO 02074438 (Gyros AB), each of which is incorporated herein by reference in its entirety. A router comprising two outwardly directed exit microconduits with no discussion about any difference in inner surface characteristics is described in WO 0147638 (Gyros AB). See also WO 9958245 (Gyros AB), each of which is incorporated herein by reference in its entirety.

Branched inlet microconduits have also been used in volume-defining units where one of the branches leads into a volume-metering microcavity and the other branch is an overflow microconduit leading to a waste reservoir or waste opening. See WO 02075775 (Gyros AB), WO 02075776 (Gyros AB), WO 02074438 (Gyros AB), WO 03018198 (Gyros AB), each of which is incorporated herein by reference in its entirety. This kind of units has not been used for liquid routing in which the liquid flow specifically goes into only one of the branches and then is switched to the other branch by increasing the force acting on the liquid.

It now has been recognized that there is a general need for improvements with respect to the possibility to freely switch back and forth between the exit microconduits of a liquid router in a controlled and regulated manner without the need of electricity, movable parts etc on the device. Thus a main object is to provide reliable routing functions for centrifugally based microfluidic devices in which a simple change in spin speed will determine into which particular exit microconduit the liquid will be directed. The length of the period of time for spinning at the particular speed should determine the amount of liquid transferred to the particular exit microconduit. A subobject is to provide liquid routers in which one can easily switch between two exit microconduits one, two, three or more times, e.g. back and forth one, two, three or more times between the exit microconduits.

Further a liquid router between two process microcavities should be robust and reliable such that two, three or more microchannel structures individually comprising the router could be run in parallel.

BRIEF SUMMARY OF THE INVENTION

The present invention relates to a liquid router (1) that comprises an inlet microconduit (3) that branches into two exit microconduits (microconduit I and II, (4 and 5, respectively) and is present in a microchannel structure (6) of a microfluidic device (7) which is using centrifugal force created by spinning the device (7) around a spin axis (8*a*) for transporting liquid.

In certain embodiments, the liquid router comprises a microcavity (9) having a lower part (10) comprising two exit openings (exit I and II, 12 and 13, respectively), and an upper part (11) comprising an inlet opening (14) to which the inlet microconduit (3) is connected. In addition to the microcavity, the router comprises microconduits I and II (4 and 5, respectively) which are connected to exits I and II, respectively, (12,13) and stretch from a shorter radial position to a larger radial position relative to the spin axis (8*a*), microconduit II (5) has a reduced hydrophilicity compared to microconduit I (4).

A further embodiment of the liquid router comprises a non-wettable patch (28) on the inner surface (17) between the inlet opening (14) and exit I (12). The patch (28) is capable of hindering liquid transport on the surface (17) from the inlet opening (14) to exit I (12). The reduced wettability can be due to hydrophobic patterning in the surface (27) of the inner wall of a) the microcavity (9) in the proximity of exit II (13) and/or b) a circumferential zone in microconduit II (5). Yet further, the inner surface (18) of the microcavity between exit I (12) and exit II (13) is non-wettable.

Another embodiment of the present invention is that the liquid router can comprise advent opening (29). The vent opening can be at a shorter radial position than exit I (12), and is capable of counteracting development of sub-pressure in the upper part (11) when liquid is leaving the microcavity (9) through exit I (12). Yet further, the non-wettable patch (28) surrounds the vent opening (29).

Another embodiment of the liquid router comprises the surface of two, three, four or more inner side-walls, preferably opposing and/or neighboring side-walls, being non-wettable within the circumferential zone.

Another embodiment of the liquid router is that it may be characterized by the ratio between the radial positions for the inlet opening and various other structures. The tendency for liquid to pass through exit I (12) will depend on the width and/or depth of the routing microcavity (9). Hence, the ratio between the difference in radial position (=radial distance) between the inlet opening (14) and exit II (13) and the largest cross-sectional dimension of the routing microcavity (9), and/or the difference in radial position (=radial distance) between the inlet opening (14) and the upper end of the local area (27) causing a reduction in the reduced apparent wettability of microconduit II (5). It is envisioned that the ratio should be ≧0.5, such as ≧1 or ≧2, with preference ≧5 or ≧10 or ≧25 or ≧50 or ≧100.

A further embodiment is a router comprising a difference in radial position between the inlet opening (14) and exit II (13) or the upper end of the hydrophobic patterning associated with the hydrophilicity of exit II (13) and microconduit II (5). The ratio can be ≧25 μm, more preferably, ≧50 μm or ≧100 μm or ≧150 μm or ≧200 μm or ≧300 μm, and ≦1000 μm, such as <600 μm or <400 μm.

Yet further, another embodiment is a router comprising the largest cross-sectional area perpendicular to the flow direction in the microcavity (9), such that the cross-sectional area is larger than the area of the inlet opening (14), for example, the area can be larger by a factor >2, such as >5 or >10 or >25 or ≧50 or ≧100.

Another embodiment is a router characterized in a microchannel structure (6) comprising a) a first process microcavity (20) in downstream fluid communication with the inlet opening (14) for processing a liquid aliquot containing one or more components to one or more other liquid aliquots which each contains: a remaining amount of one, two or more of said one or more components, and/or one or more product components formed during the processing, and b) a second process microcavity (30,32) in upstream fluid communication with one of the outlet microconduits (4,5) for processing at least one of said one or more other liquid aliquots. In certain embodiments, the first and second process microcavities (20,30,32) are selected from a) separation microcavities (e.g. containing a solid phase as separation medium such as a solid phase in the form of a porous bed or the surface of the process microcavity, such as a size exclusion solid phase, and a solid phase exhibiting one or more affinity groups including e.g. hydrophobic groups, charged groups, amphoteric groups, hydrophilic groups etc), b) affinity reactors (i.e. microcavities for performing homogeneous or heterogeneous affinity reactions such as homogeneous and/or heterogeneous enzyme reactions, homogeneous and/or heterogeneous affinity reactions between receptors and ligands including reactions between antibodies, their antibody-active fragments, analogues etc and corresponding affinity counterparts such as antigens, antigen fragments, haptens etc, c) detection microcavities that may be open or closed to ambient atmosphere, and d) microcavities in which a combination of different kinds of processes can be carried out, the kinds of processes, for instance, being selected from separations, affinity reactions, and detections.

In a further embodiment, the router is characterized in that two or more of the microchannel structures (6) are present in the microfluidic device (7). The microfluidic device (7) is disc-shaped with each microchannel structure (6) being essentially planar with the disc plane and the spin axis (8*a*) preferably being orthogonal or parallel to the disc plane. A disc-shaped device can have an axis of symmetry (Cn, n=2, 3, 4, 5, 6 . . . ∞) (8*a*) that is orthogonal to the disc plane. The axis of symmetry and spin axis (8*a*) can coincide, with preference for the microfluidic device (7) being circular.

Another embodiment of the present invention is a method for partitioning a liquid between two branches (exit microconduit I and II) (4,5) of an inlet microconduit (3) within a microchannel structure (6) of a microfluidic device (7) designed such that liquid can be driven by centrifugal force through the liquid router by spinning the device (7) about a spin axis (8*a*), characterized in comprising the steps of: (i) providing a microfluidic device (7) comprising at least one microchannel structure (6) which comprises an inlet port (35) for liquid in downstream fluid communication with the inlet microconduit (3) of the liquid router of the present invention, (ii) providing liquid in the inlet microconduit (3), (iii) spinning the device (6) at a speed (speed 1) that will establish a surface liquid flow from the inlet opening (14) and downwards on the inner surface (16*a*,16) of the routing microcavity (9) to a local area (27) that hinder downward transport such that a growing droplet will be formed in the routing microcavity (9) and/or in exit microconduit 11 (5), speed 1 being selected amongst speed 1*a* and speed 1*b* where a) speed 1*a* causes the liquid to only pass through exit microconduit 1 (12), i.e. the free surface of the growing droplet will reach a wettable inner surface (19,17) that is a) within exit microconduit I (4), or b) within the routing microcavity (9) and stretches into exit microconduit I (4), and b) speed 1*b* causes liquid to only pass through exit microconduit II (12), i.e. the droplet will pass over the local area (27) down into exit microconduit II, changing to speed 1*b* if speed 1*a* has been selected in step (iii) thereby switching liquid transport from exit microconduit I (4) to exit microconduit II (5), or changing to speed 1*a* if speed 1*b* has been selected in step (iii) thereby switching liquid transport from exit microconduit 11 (5) to exit microconduit I (4).

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which:

The microfluidic device illustrated in the drawings has a diameter of 12 cm, i.e. the conventional CD format. FIG. 1 is essentially in 1:1 scale. The depth of the structures is typically 100 μm. Measures in μm are given in FIG. 2. Upward/inward direction has been indicated with an arrow (8) in FIGS. 2-4.

DETAILED DESCRIPTION OF THE INVENTION

I. Definitions

Figure 1:
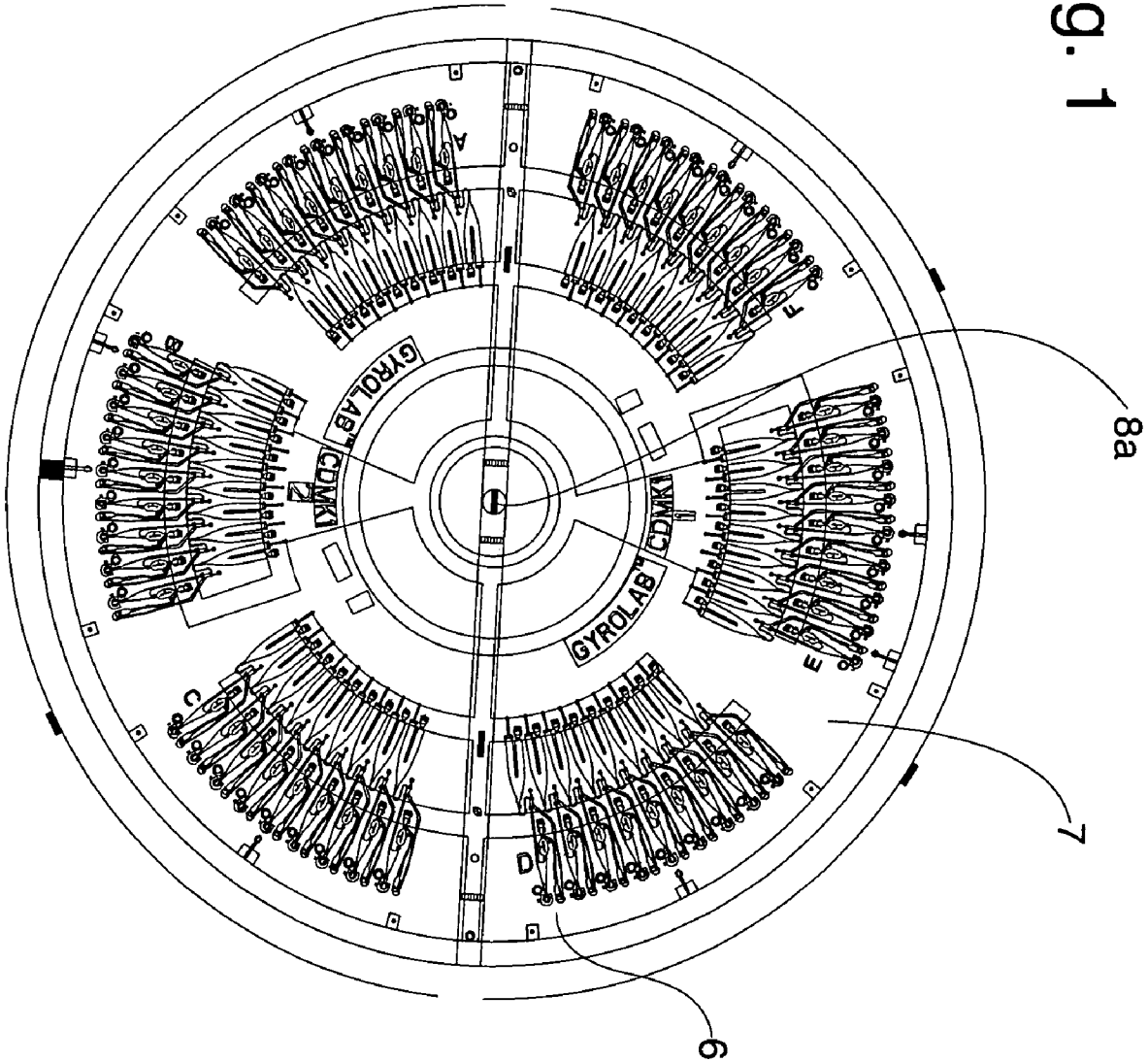
FIG. 1 shows a microfluidic device intended for spinning around a central spin axis. The device comprises 6×9 microchannel structures each containing a liquid router according to the invention.

Unless defined otherwise, technical and scientific terms used herein have the same meaning as commonly understood by one of ordinary skill in the art to which this invention belongs. For purposes of the present invention, the following terms are defined below.

The term microfluidic means that one or more liquid volumes (aliquots) in the μl-range containing reactants, buffers or the like is transported and processed within a microchannel structure of a microfluidic device according to a predetermined process protocol. The protocols concerned may contain one or more distinct steps such as separation, affinity reaction, chemical and/or biochemical reaction, detection etc, which are to take place in different parts of the microchannel structure.

Expressions suggesting that that different parts of a microchannel structure are connected to each other inherently means that liquid is intended to be transported between the parts, if not otherwise apparent from the context.

Typical process protocols for microfluidic devices have an analytical, synthetic, preparative etc purpose and are typically used within the life science area or related areas such as organic, analytical, inorganic, physical etc chemistry. The life science area comprises natural sciences such as biology, medicine (human, veterinary and plant medicine), diagnostics, biochemistry, molecular biology, biochemistry etc.

The terms "upper"/"higher" and "lower" refer to the radial position relative the spin axis, i.e. an upper part or higher level is closer to the spin axis than a lower part or level. Upward/inward/above means toward the spin axis and downward/outward/below means from the spin axis. These definitions apply unless otherwise is apparent from the context.

II. The Invention

The present inventors have recognized that the objects can be accomplished by appropriately combining inner geometry and inner surface characteristics of a liquid router (1) at the branching (2) of its inlet microconduit (3).

The first aspect of the invention is a liquid router (1) that comprises an inlet microconduit (3) that branches into two exit microconduits (microconduit I and II) (4 and 5, respectively). The router (1) is present in a microchannel structure (6) of a microfluidic device (7), which is using centrifugal force created by spinning the device around a spin axis (8*a*) for transporting liquid.

The main characteristic feature of this aspect is that the router (1) comprises:

a routing microcavity (9) which has: a lower part (10) comprising two exit openings (exits I and II) (12 and 13, respectively), and an upper part (11) comprising an inlet opening (14) to which the inlet microconduit (3) is connected, and microconduits I and II (4 and 5) which are connected to exits I and II (12 and 13, respectively) of the routing microcavity (9) stretch from a shorter radial position to a larger radial position relative to the spin axis (8*a*).

The apparent wettability (=hydrophilicity) associated with microconduit II (5) and exit II (13) is reduced compared with the apparent wettability associated with microconduit I (4) and exit I (12). This contemplates that a liquid that partially has filled the routing microcavity (9) via the inlet microconduit (3) and is in contact with exit I (12) and/or exit II (13) is leaked out through exit I (12) into microconduit I (4) by wicking. No or a much less wicking is taking place through the other exit microconduit (II) (5). A reduction in apparent wettability can preferably be accomplished by appropriate hydrophobic (non-wettable) patterning around exit II (13) and/or on the inner surfaces of microconduit II (5).

Apparent wettability/hydrophilicity of a particular exit microconduit or of an exit of a microcavity thus reflects the ability of an aqueous liquid, such as water, to enter, pass or leak through or fill up the microconduit/exit by self-suction and/or capillarity. A microconduit and an exit from a microcavity may have a high apparent wettability/hydrophilicity but still be associated with liquid contact surfaces that in essence are non-wettability as long as there are correctly placed wettable surfaces around or within the exit/microconduit. A grading of the apparent wettability/hydrophilicity of two microconduits (e.g. exit microconduits I and II) is most simply obtained by determining which of them easiest is filled by an aqueous liquid.

The major portion of the inner surfaces that are to be in contact with liquid is typically wettable (hydrophilic) in order to facilitate transport of liquid by wicking and capillarity. Thus these surfaces typically have a water contact angle (pure water, room temperature) that is <90°, more preferably ≦60° or ≦40°≦30°≦25°. Wettability within these ranges may be present on one, two, three, four or more of the inner sides. In the case one or more of the inner sides are non-wettable or have an insufficient wettability this can be compensated by increasing the wettability of one or more of the wettable sides. Hydrophobic areas or inner sides typically have a water contact angle that is ≧90°, such as ≧100° or ≧120°. Patching or patterning the relevants parts of the liquid router typically can be used to introduce the hydrophobic areas. This may be carried out by printing, stamping, spraying etc the patches before the corresponding open structure is enclosed during the manufacturing.

The inlet opening (14) and the exit microconduits (4 and 5) and the routing microcavity (9) typically have a cross-sectional area in the form of a polygon, e.g. is triangular, rectangular, square-shaped, trapezoidal etc. There are typically length-going inner edges (15*a,b* . . . ) defined by intersecting sidewalls, for instance by a sidewall intersecting the bottom side or the top side.

Suitable dimensions of the inlet microconduit (3) and exit microconduits (4 and 5) and the routing microcavity (9) can be found within the same ranges as known for microchannel structures in microfluidic devices, i.e. at least one cross-sectional dimension (width and/or depth), typically both, are selected within the interval of 0.5 μm to 1000 μm, such as 1-1000 μm or 2-700 μm or 2-500 μm.

The invention is based on the discovery that by properly adapting the spin speed for this kind of liquid router, the liquid will slowly pass out from the inlet opening (14) and be transported downwards on the inner surface (16) connecting the inlet opening (14) with exit II (13). Due to the reduced apparent wettability associated with exit II/microconduit II (13/5) the liquid will stop before being transported out through microconduit II (5). Since liquid is passing out continuously from the inlet opening (14), a resting liquid droplet will form and continuously increase in volume below the inlet opening (14). When the drop is large enough it will enter into contact with the opposite surface (17) of the inner wall of the routing microcavity (9) above exit I (12) and/or sneek around the uppermost area (18) between exits I and II (12 and 13). As soon as the droplet reaches a wettable area that is present in the inner surfaces (19) of microconduit I (4) or is extending into the opposite inner surface (17) of the routing microcavity (9), wicking will quickly transport the liquid further downstream into microconduit I (4). This downward transport is likely to be supported by the centrifugal force created by spinning the microfluidic device (7). A slight increase in spinning/centrifugal force will give an essential continuous liquid flow along the same path.

By further increasing the spinning, the outwardly directed centrifugal force acting on the droplet collected below the inlet opening (14) will cause it to be transported downwards through microconduit II (5) instead of following the path outlined for the lower spin speed. An appropriate increase in spinning will facilitate for the liquid to overcome the reduced apparent wettability associated with microconduit II (5). By reducing the spinning the liquid will resume being transported through microconduit I (4).

The required spin speed for a particular routing of liquid will in a complex manner depend on various factors, such as geometry and cross-sectional dimensions of the router microcavity, configuration and cross-sectional dimensions of the microconduits connected to the routing microcavity, surface tension of the liquid, distance from the spin axis, difference in apparent wettability between microconduits I and II including the hydrophobic patterning around exit II and within microconduit II, possible hydrophilic patterning within microconduit I, wettability of areas that have not been hydrophilically patterned (for instance within the routing microcavity, the inlet microconduit and the exit microconduits), etc.

III. Inlet Microconduit

The inlet microconduit (3) is typically in the upstream direction in fluid communication with a liquid reservoir (20) that preferably at least partially is at a higher level than the inlet opening (14).

The cross-sectional dimensions and the form (length, curvature etc) of the inlet microconduit (3) are not particularly important. The inlet microconduit (3) may have cross-sectional dimensions (width and depth) and/or a cross-sectional area that are/is constant or increasing or decreasing or alternating constant, increasing and/or decreasing. At least one of the width and the depth and/or the cross-sectional area next to the inlet opening (14) should be smaller than the cross-sectional dimensions and/or the cross-sectional area of the routing microcavity (9).

The dimensions and form of the inlet microconduit (3) are typically selected to fit a process step to be carried out in a liquid reservoir (20) placed upstream the inlet microconduit (3). If the process step requires a solid phase (21) in the reservoir (20), the design should facilitate controlled flow of the liquid passing the bed the bed and/or prevent the bed from being drained. This may be accomplished with the design given in the drawings, i.e. the inlet microconduit (3) should be relatively narrow causing a significant pressure drop and should have a downward bent (22) that at least at its lower extreme (23) is at a lower level than the inlet opening (14) and preferably also is below the lower part (10) of the routing microcavity (9). There is typically also an upward bent (24) between the downward bent (22) and the inlet opening (14), and the upper extreme (25) of this bent is preferably above the inlet opening (14). The solid phase (bed) (21) is placed on a level that is below the extreme (25) of the upward bent (24) and possibly also below the inlet opening (14). The solid phase may be the inner surface of at least a part of the reservoir (20) or a porous bed in the form of a porous plug or a packed bed of particles. Chromatographic beds are examples of porous beds. The process step typically contemplates affinity adsorption to the solid phase (21) (=affinity bed), or some other kind of heterogeneous reaction between a dissolved reactant and a group/reactant that is immobilized to the solid phase. Narrow microconduits and their use for facilitating controlled flow has been discussed in detail in WO 02075312 (Gyros AB) and WO 03024598 (Gyros AB), each of which is incorporated by reference herein in its entirety, and can in principle also be used for most other process steps that is to be performed in the upstream reservoir (20), even if a particular step may have its own preferred designs.

The wettability of the inlet microconduit (3) is not critical for good liquid transport. In preferred cases, however, the wettability should be sufficient for pure water to fill the conduit by capillary action ("self suction"), once it has entered through one of its ends, e.g. the inlet opening (14) of the routing microcavity (9) or the end (26) in fluid communication with an upstream liquid reservoir (20). The preferred wettability of inner surfaces of the inlet microconduit (3) is typically found within the ranges discussed above.

The liquid reservoir (20) may be intended for a particular process step, i.e. is a process microcavity as discussed below or may simply be a reservoir for collecting and/or mixing liquids before further transport downstream into the liquid router.

IV. Routing Microcavity

The dimensions of the routing microcavity (9) are typically selected within the ranges generally given above for liquid routers.

It is believed that the cross-sectional dimensions (width and depth) and/or the cross-sectional area of the routing microcavity is not critical although specific effects presumably can be achieved in the case at least one of these measures is constant, increasing, and/or decreasing for the full length of the routing microcavity (9) or for a part of it.

The uppermost part of the inner surface area (18) between microconduits I and II (4,5) defines the lowest point of the routing microcavity, i.e. the inner volume of the router (9) below this point/part belongs to the exit microconduits (4,5). The level of this point/part also defines the radial position of exit I and II (12,13).

The largest cross-sectional area of the routing microcavity (9) perpendicular to the flow direction and/or the radial direction is typically larger than the area of the inlet opening (14) of the routing microcavity, e.g. by a factor >2, such as >5 or >10 or >25 or ≧50 or ≧100. In most instances this factor is not exceeding 1000.

The inlet opening (14) should be separated from the upper end of the hydrophobic patterning (27,27*a*,27*b*) associated with the reduced apparent wettability of exit II (13) and microconduit II (5). The corresponding distance, i.e. the difference in radial position (=radial distance) between the inlet opening (14) and exit II (13), and/or between the inlet opening (14) and the upper end of the hydrophobic patterning (27) and of other local areas influencing the apparent wettability of exit II (13) and microconduit II is typically ≧25 μm, such as ≧50 μm or ≧100 μm or ≧150 μm or ≧200 μm or ≧300 μm. This distance is in most embodiments ≦2000 μm, such as ≦1000 μm or ≦600 μm or ≦400 μm. A certain length is beneficial because a longer distance will support the formation of a higher liquid pillar/drop than a shorter distance. This in turn will render it simpler to force liquid into microconduit II instead of into microconduit I (less force, lower spin speed). As indicated these ranges also apply to other types of local areas reducing the apparent wettability of microconduit II (5).

The tendency for liquid to pass through exit I (12) will depend on the width and/or depth of the routing microcavity (9). Hence, the ratio between the difference in radial position (=radial distance) between the inlet opening (14) and exit II (13) and the largest cross-sectional dimension of the routing microcavity (9), and/or the difference in radial position (=radial distance) between the inlet opening (14) and the upper end of the local area (27) causing a reduction in the reduced apparent wettability of microconduit II (5) should be ≧0.5, such as ≧1 or ≧2, with preference ≧5 or ≧10 or ≧25 or ≧50 or ≧100.

The part (16*a*) of the inner surface (16) that is next to the inlet opening (14) preferably is wettable and has a direction that is closer to the outward/downward radial direction (8) from the intended spin axis than other inner surface parts (e.g. 17*a*) that are next to the inlet opening and are more angled towards the radius. The angle between the wettable surface part (16*a*) and the radial direction at inlet opening (14) is typically ≦90°, such as ≦45° or ≦25° or ≦10° or essentially the same as the outward radial direction (≦5°). These figures represent absolute values and thus include both positive and negative angles from the radial direction.

In a preferred variant, the routing microcavity (9) comprises a non-wettable patch or patterning (28) on its inner surface (17) between the inlet opening (14) and exit I (12) (inner surface (17) including the part (17*a*) that is next to the inlet opening (14)). The patch or patterning should cover inner edges in order to optimally hinder undesired liquid transport on the surface from the inlet opening to exit I. This patch/patterning is preferably present in the upper part (11). This local area (28) could also exhibit a change in geometric surface characteristics as discussed below.

Local non-wettable areas may also be located in the surface (16) between the inlet opening (14) and exit II (13) (not shown), see below, and on the inner surface (18) between exit I and exit II. Such an area (not shown) between the inlet opening (14) and exit II (13) would also mean that the liquid would stop at a higher level within the routing microcavity (9) than if it is not present.

The upper part (11) of the routing microcavity (9) preferably has a vent opening (29) in the surface (17) of the inner wall stretching from the inlet opening (14) to exit I (12). The vent opening (29) typically is designed for leveling out over pressure or sub pressure that might be formed when liquid is entering through the inlet opening (14) and/or exiting through exit microconduit I or II (4,5). The vent opening (29) is preferably surrounded by a non-wettable surface area or patch (28), for instance coinciding at least partially with the non-wettable areas used for hindering undesired initial leakage of liquid from the inlet opening (14) to exit microconduit I (12). The vent opening (29) is typically directly connected to a vent microconduit (29*a*) that leads to ambient atmosphere. This vent microconduit (29*a*) typically has non-wettable inner surfaces at least next to the vent opening. This vent opening/microconduit (29/29*a*) is physically separated from the inlet opening/microconduit (14,3).

V. Exit Microconduits

An exit microconduit (4,5) may be straight or curved. It may have a cross-sectional area and/or cross-sectional dimensions that is/are constant along its length or be narrowing or widening in the downstream direction, for instance next to its junction with the routing microcavity (2). This may apply to either one or both of the two exit microconduits (4,5).

An exit microconduit (4,5) may in the downstream direction be in fluid communication with a reservoir (downstream reservoir) (30) for retaining liquid reaching the reservoir via the exit microconduits. The reservoir (30) may be for waste (waste reservoir) or for processing the liquid aliquot routed by the routing microcavity (9) into the reservoir (process microcavity). See below. The reservoir connected to one of the exit microconduit (4,5) may be replaced with a waste outlet (31) that is open to ambient atmosphere.

The downstream reservoir (30) and the waste outlet opening (31), if present, typically are at a lower level than the routing microcavity (9).

The reduction in apparent wettability of exit microconduit II (5) can be accomplished by introducing local areas (27), which comprises a change in surface characteristics relative to the surrounding upstream and downstream inner surfaces. This change may relate to geometric and/or chemical surface characteristics. This kind of local areas is typically located on the inner wall/surface of exit microconduit II (5) and/or the inner wall/surface (16) of the lower part (10) of the routing microcavity in proximity of exit II (13), preferably on a part over which liquid transported downwards from the inlet opening by centrifugal force is to pass. When the liquid front reaches the boundary where the change starts, the front will stop and an increasing drop will form until the surface of the drop reaches a wettable area (17,19) that is extending into exit microconduit I (4) or until the height of the drop overcomes the flow barrier created by the local area (27). By increasing the spin speed a smaller height is required for passage into microconduit II (5). See discussion above.

The change in surface characteristics may relate to a change in geometric and/or chemical surface characteristics. Typical geometric changes are abrupt changes in the form of ridges and grooves that are essentially perpendicular to the direction of the liquid transport. Typical changes in chemical surface characteristics relate to decreased wettabilies (increased hydrophobicity or reduced hydrophilicity) of surfaces, for instance to non-wettability within the ranges generally described above.

Within the routing microcavity (9) or exit microconduit II (5), the local area (27) comprising the change is typically present in the surface of one, two, three, four or more inner side walls (including bottom and top). In the case the local area is present on more than one inner sidewall, these sidewalls are typical opposing and/or neighboring. A local area comprising a change in surface characteristics preferably also comprises inner edges defined at the same radial and/or angular position as the local area.

The length in the downstream direction of a local area (27) comprising the change is typically ≦50 times, such as ≦25 times or ≦10 times or ≦5 times or essentially equal to the largest cross-sectional dimension at its upstream end. This does not exclude that the length can be ≦0.5 times, such as ≦0.1 times or ≦0.01 times the largest cross-sectional dimension at the upstream end of the local area. As a rule the length of the local area is typically ≧5 μm, such as ≧10 μm or ≧50 μm. The upper limit is typically 2000 μm or 1000 μm.

VI. Liquid Reservoirs

The liquid router of the invention is in the upstream direction via the inlet microconduit (14) in fluid communication with a liquid reservoir (20) and in the downstream direction via one or both of exit microconduits I and II (4,5) in fluid communication with one, two or more other liquid reservoirs (30,32). These liquid reservoirs and the liquid router are part of the same microchannel structure (6).

Figure 2:
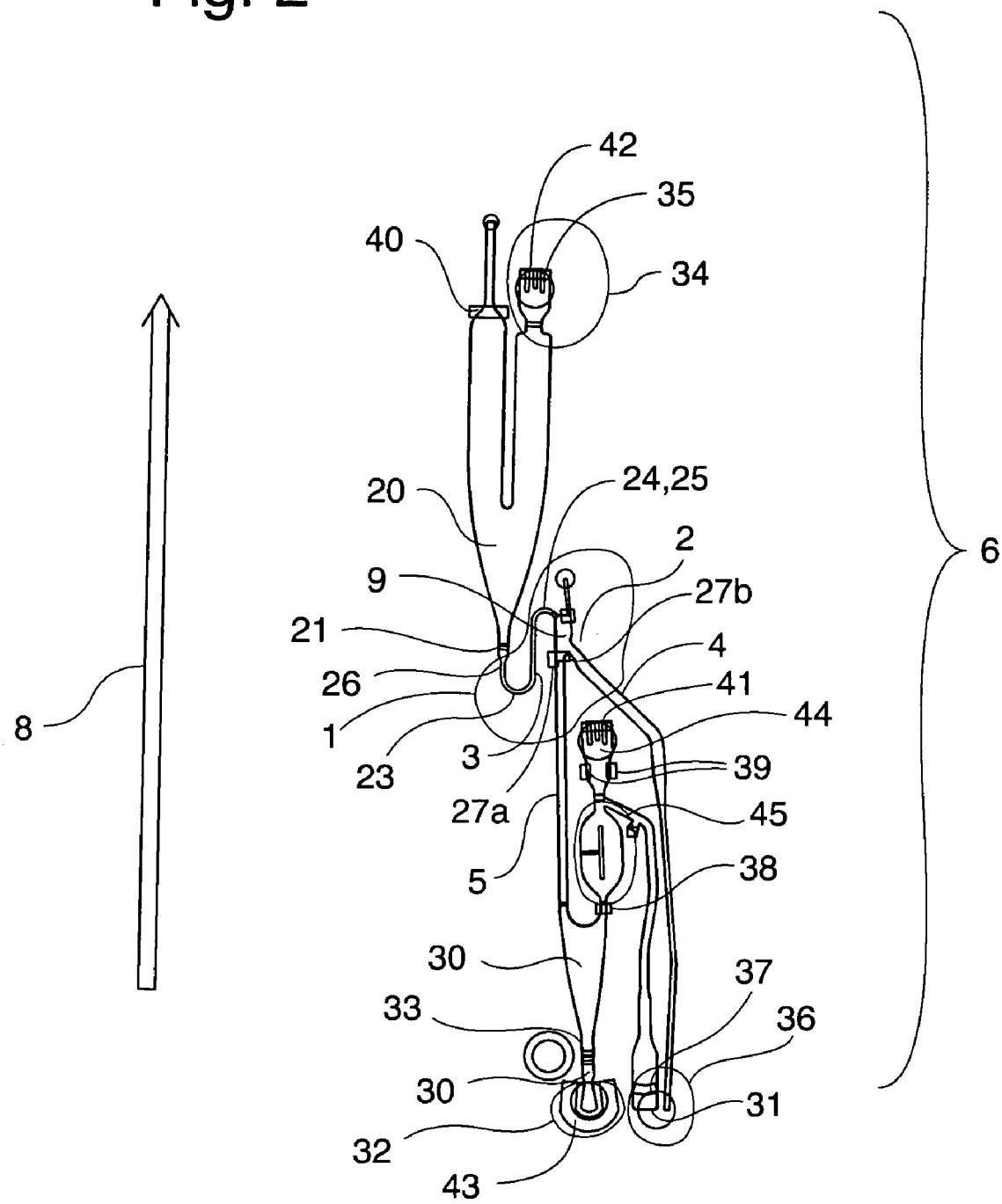
FIG. 2 shows an enlarged single microchannel structure of the same kind as in FIG. 1.

One of the exit microconduits (4,5) may be in fluid communication with a waste outlet opening (31) that for instance may be common for two or more microchannel structures (6) or for waste outlets from different parts of the same microchannel structure (31 in FIG. 2).

A liquid reservoir in this context means a microcavity that is capable of retaining a liquid aliquot that is to be or has been transported through the liquid router (1) of the invention (upstream reservoir (20) and downstream reservoirs (30,32), respectively). A liquid reservoir may be used only for retaining or collecting a liquid aliquot, for instance during a time period when one or more other liquid aliquots are processed within the microchannel structure. This includes, for instance that the reservoir is a waste reservoir. Typically, however, a liquid reservoir is used for processing a liquid aliquot according to one or more steps included in the process protocol carried out within the microhannel structure concerned. Liquid reservoirs may be open to ambient atmosphere, see for instance the MALDI MS detection microcavity (32) used in the experimental part.

Reservoirs that are used only for retaining liquid without processing are called storage reservoirs or storage microcavities. Reservoirs that are used for processing liquid aliquots are called process microcavities. Processing in this context includes performing mixing, metering diluting etc liquid aliquots, evaporation, dissolving, separation, inorganic and/or organic chemical reactions, catalytic reactions, biochemical reactions, cell culturing, cell reactions, detection, affinity reactions etc. The same reservoir may be used for one, two or more operations, e.g. diluting and a chemical reaction, etc.

A liquid reservoir typically has valve function associated with its outlet to reduce or control liquid flow out of the reservoir. This valve function may be a passive valve or some other kind of non-closing valve that typically is based on a local change in geometric and/or chemical surface characteristics (wettability/non-wettability). See e.g. WO 02074438 (Gyros AB) and WO 9807019 (Gamera Biosciences), each of which is incorporated by reference herein in its entirety. Porous beds (21,33) such as porous monolithic beds (plugs) and packed beds are considered as valves in the sense that they create a counter-pressure reducing liquid flow out of a reservoir (20,30).

Biochemical reactions in the context of process microcavities includes affinity reactions based on biological interactions, biocatalytic reactions such as enzymatic reactions, cell reactions, bioaffinity reactions such as affinity reactions based on biological interaction and utilizing at least one biologically derived affinity reactant.

A process microcavity may be named after the kind of reaction to which it is adapted, e.g. separation microcavity, enzyme microcavity, bioaffinity microcavity, immunosorbent microcavity, ion exchange microcavity, mixing microcavity, evaporation microcavity etc. If appropriate, the word microcavity is often replaced with the word microreactor or simply reactor.

If heterogeneous reactions are to be carried out, the process microcavity typically contains a solid phase, for instance in the form of the surface of its inner walls or as a porous bed (21,33), for instance a bed packed of particles or a porous plug. Depending on the process to be carried out, the solid phase may expose an immobilized reagent or group (ligand or receptor) that is to participate in the process/reaction. In certain separation processes for instance solely based on electrophoresis and/or size exclusion, the solid phase may be devoid of such groups and function primarily as anti-convective or sieving medium, respectively.

Typical affinity ligands have affinity counterparts and are illustrated with: charged groups comprising positively and/or negatively charges with a positive, negative or zero net charge, and hydrophobic groups, and. bioaffinity groups. Bioaffinity groups include groups derived from antibodies, antigens, haptens, carbohydrates, lectins, nucleic acids, hormones, lipids, enzyme reactants, biotin, streptavidin etc and other kinds of receptors or ligands that have an affinity counterpart. Enzyme groups include enzymes as such, cofactors, coenzymes, substrates, cosubstrates etc. Hormones include peptide hormones, steroid hormones, phytohormones etc. Bioaffinity groups also include groups that are synthetic in nature but which have affinity for a biomolecule. It follows that a bioaffinity group and/or its affinity counterpart typically exhibits at least one structure selected amongst: steroid structures, lipid structures, peptide structures including protein, polypeptide, oligopeptide or amino acid structures, carbohydrate structures, and nucleic acid structures including oligonucleotide, polynucleotide and nucleotide structures.

A process microcavity may comprise any of the above-mentioned process functions and/or chemical/biochemical structures, either alone or in combination.

In preferred variants the liquid router (1) is part of a microchannel structure (6) that comprises: a first process microcavity (20) in downstream fluid communication with the inlet microconduit (3). The microcavity is used for processing a liquid aliquot containing one or more components to one or more other liquid aliquots which each contains a remaining amount of one, two or more of said one or more components, and/or one or more product components formed during the processing. A second process microcavity (30,32) in upstream fluid communication with one of the exit microconduits (4,5) for processing at least one of said one or more other liquid aliquots.

VII. Liquids to be Processed within a Microchannel Structure

At least one, preferably all, of the liquid aliquots to be processed according to a given process protocol within a microchannel structure (6) that comprises the present liquid router (1) has a surface tension >5 mNm, preferably >10 mNm, such as >20 mNm. Typical liquids are aqueous and may or may not include an organic solvent that either alone or in combination with one or more other organic solvents are miscible with water.

At least one of the liquid aliquots or reagents used typically have a biological origin, for instance by comprising one or more of the structures given above or deriving from a biological fluid or biological material such as a cell or tissue homogenate, a cell supernatant, whole blood, plasma, serum or blood cells, saliva, urine, cerebrospinal fluid, lachrymal fluid, regurgitated fluid, feces, lymph, vomited fluid, intestinal fluid, gastric fluid etc.

There may also be used liquid aliquots that lack reagents, reactants and the like. These liquids are typically used as diluents, washing liquids, desorbants etc. This kind of liquids may contain at least one member selected from the group consisting of buffering systems, detergents, water-miscible organic solvents etc.

Liquid volumes/aliquots that are processed within the device typically are in the μl-range, i.e. ≦5000 μl, preferably in the nl-range, i.e. 5000 nl, such as ≦1000 nl or ≦500 nl or ≦100 nl or ≦50 nl, which in turns includes the pl-range i.e. ≦5000 pl, such as ≦1000 pl.

VIII. Microfluidic Device and Microchannel Structures in General

A second aspect of the present invention is a microfluidic device (7) characterized in comprising one or more microchannel structures (6) containing a liquid router (1) as defined for the first aspect of the invention. The term microfluidic device (7) has been defined in the introductory part.

The innovative microfluidic device (7) is adapted to be spun around a spin axis (8*a*) in order to drive liquid between two or more structural subunits within the present innovative liquid router. The device may also be designed such that centrifugal force can be used to drive liquid flow between other functional units of a microchannel structure. This means that when the device is placed in the appropriate spinner at least an upstream portion of each microchannel structure has to be closer to the spin axis than a downstream portion of the same microchannel structure. This in particular applies to an upstream and downstream portion of the liquid routers of the invention, such as the upper and lower part, respectively, of the routing microcavity.

The microfluidic device is typically disc-shaped with each microchannel structure essentially parallel with the disc plane. This variant of the innovative microfluidic device typically has an axis of symmetry ($C_n$, n=2, 3, 4, 5, 6 . . . ∞) that is orthogonal or parallel to the disc plane.

The spin axis may or may not intersect the device. In certain preferred variants the spin axis is orthogonal to the disc plane and coincides with the axis of symmetry for which n typically is ∞ (=a circular device). This is illustrated in FIGS. 1-5. Variants in which the spin axis is parallel to the disc plane without intersecting the device are given in WO 2004050247 which hereby is incorporated by reference in its entirety.

A microfluidic device of the invention typically comprises one, two or more, such as ≧10 or ≧50 or ≧100, microchannel structures which each has a liquid router according to the invention. Each microchannel structure is oriented as discussed above which in the typical case means that the structures are in one or more annular rings.

Each microchannel structure (6) comprises an inlet arrangement (34) with an inlet port (35), a downstream liquid reservoir (20) of the type discussed above connected to a liquid router (1) of the invention via an inlet microconduit (3) of the router (1). To one or more of the exit microconduits (4,5) are directly or indirectly connected at least one downstream liquid reservoir (30,32) as described in the context of the innovative liquid router (1). To one or more of the exit microconduits (4,5) are connected a waste arrangement (36) either in the form of a waste reservoir or a waste outlet (31). One can envisage that one or more liquid routers according to the invention or of some other kind may be inserted between an exit microconduit (4,5) and a downstream reservoir (30, 32) or waste outlet (31). In this latter variant an exit microconduit is connected to the inlet microconduit of an additional liquid router downstream to the first liquid router. In this way the exit microconduit of an upstream liquid router may be in fluid communication with two or more liquid reservoirs (not shown).

The dimension of the microchannel structures (width and/or depth) has been discussed above in the context of the liquid router.

The transport of liquid within the microchannel structures may also be driven by forces other than centrifugal forces, for instance other inertia forces, electrokinetic forces, capillary forces, hydrostatic forces etc. Pumping mechanisms and/or pumps of various kinds may be used. Typically centrifugal force and/or capillary force are utilized in the liquid router of the invention and at least also in inlet arrangements.

The microfluidic device may be made from different materials, such as plastic material, glass, silicone etc. Polysilicone is included in plastic material. From the manufacturing point of view plastic material is many times preferred because this kind of material is normally cheap and mass production can easily be done, for instance by replication. Typical examples of replication techniques are embossing, moulding (including injection moulding) etc. See for instance WO 9116966 (Pharmacia Biotech AB, Öhman & Ekström), which is incorporated by reference herein in its entirety. Replication processes typically result in open microchannel structures as an intermediate product, which, subsequently is covered by a lid or top substrate, for instance according to the procedures presented in WO 0154810 (Gyros AB, Derand et al) or by methods described in publications cited therein, each of which is incorporated by reference herein in its entirety. The proper hydrophilic/hydrophobic balance is preferably obtained according to the principles outlined in WO 0056808 (Gyros AB, Larsson et al) and WO 0147637 (Gyros AB, Derand et al), each of which is incorporated by reference herein in its entirety. Suitable wettability ranges are found within the same intervals as discussed herein for the present liquid router. In addition to the non-wettable inner surfaces of the liquid router, non-wettable surfaces may also be present in other parts of a microchannel, for instance in non-closing and/or passive valve functions and in anti-wicking means.

A mcrochannel structure comprising the liquid router of the invention is a third aspect of the invention.

IX. Method Aspect

The fourth aspect of the invention is a method for partitioning a liquid between two branches (exit microconduit I and II) (4 and 5, respectively) of an inlet microconduit (3) within a microchannel structure (6) of a microfluidic device (7) designed such that liquid can be driven by centrifugal force through a liquid router (1) of the device by spinning the disc around a spin axis (8). The method is characterized in comprising the steps of: providing a microfluidic device (7) comprising at least one microchannel structure (6) which comprises an inlet port (35) for liquid that in the downstream direction is in fluid communication with the inlet microconduit (3) of a liquid router (1) as defined in the first aspect of the invention; providing liquid in the inlet microconduit (3); spinning the device at a speed (speed 1) around the spin axis (8*a*) that will establish a surface liquid flow from the inlet opening (14) and downwards on the inner surface (16) of the routing microcavity (9) to a local area (27) that hinder further downward transport in such a manner that a growing droplet will be formed in the routing microcavity (9) and/or in exit microconduit II (13); speed 1 being selected amongst speed 1*a* and speed 1*b* where speed 1*a* causes the liquid to only pass through exit microconduit I (4), i.e. the free surface of the growing droplet will reach a wettable inner surface (17,19) that is a) within exit microconduit I (5), or b) within the routing microcavity (9) and stretches into exit microconduit I (4), and speed 1*b* causes liquid to only pass through exit microconduit II (5), i.e. the droplet will pass over the local area (27) down into exit microconduit II (5), changing to speed 1*b* if speed 1*a* has been selected in step (iii) thereby switching the liquid flow from exit microconduit I (4) to exit microconduit II (5), or changing to speed 1*a* if speed 1*b* has been selected in step (iii) thereby switching the liquid flow from exit microconduit II (5) to exit microconduit I (4). Speed 1*b* is >speed 1*a*, typically by a factor >1, such as ≧1.10 or ≧1.25 or ≧1.5 or ≧2 or ≧2.5 or ≧3.5 or ≧5 or ≧10.

In the typical case a liquid reservoir (20) is present between the inlet port (35) and the inlet conduit (3) of the router (1).

The actual interval for useful values of speed 1 depends of a number of factors including cross-sectional dimensions and length of the inlet microconduit, geometry of the routing microcavity and the exit microconduits, wettability of the surfaces inside the different parts of the router, configuration around within and/or around the liquid router, radial position (=radial distance from the spin axis) of the router etc. Typical values for speed 1 (including speed 1*a* and 1*b*) for circular devices of the type given in the drawings are found in the interval 1000-5000 rpm, such as 2000-5000 rpm.

The method is useful for performing liquid routing in one two or more of the process steps discussed above, typical with a reservoir (20) upstream and another reservoir (30,32) downstream the liquid router (1). A typical process step for which the innovative routing can be used is a separation step comprising separating a component from a liquid by adsorbing it to an affinity adsorbent followed by desorbing the component from the affinity adsorbent by the use of a desorbing liquid. The present liquid routing method can be applied to this kind of separation if the liquid router is linked to an upstream reservoir (20) that comprises a solid phase (21) exposing an affinity ligand, and a downstream microcavity that is used for collecting the desorbed component is linked to one of the exit microconduits. The solid phase may be of type discussed elsewhere in this specification. Presuming that a) exit microconduit II (5) is linked to the downstream microcavity (30), b) sample liquid (contains the component to be adsorbed) and washing liquid are introduced via the inlet (35) of the reservoir (20), and c) the device is spinned at spin speed 1*a*, liquid will leave the liquid router through exit microconduit I (4) while the component is retained on the solid phase (21) in reservoir (20). Subsequent introduction of the desorption liquid through the same inlet (35) and spinning at spin speed 1*b* will place the desorption liquid together with the component in the downstream microcavity (30). If the desorbed component is to be further processed the downstream microcavity may be designed to allow for such further processing and/or additional microcavities may be included in the structure downstream the first downstream microcavity. Further processing may include adsorption of the component to a solid phase followed by reaction on the solid phase and release of the products created to a detection microcavity. Compare the experimental part and the variant illustrated in the drawings. The component may be an analyte to be characterized.

X. Experimental Part

Figure 3:
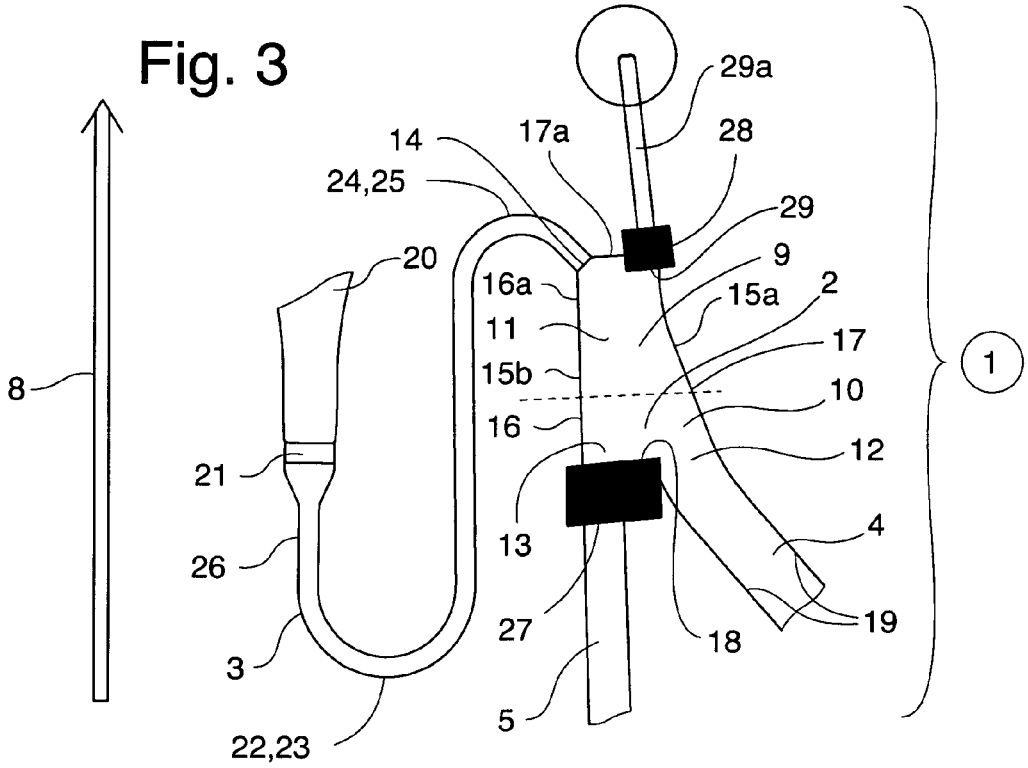
FIG. 3 shows an enlarged variant of the router of the microchannel structure of FIG. 2.
Figure 4:
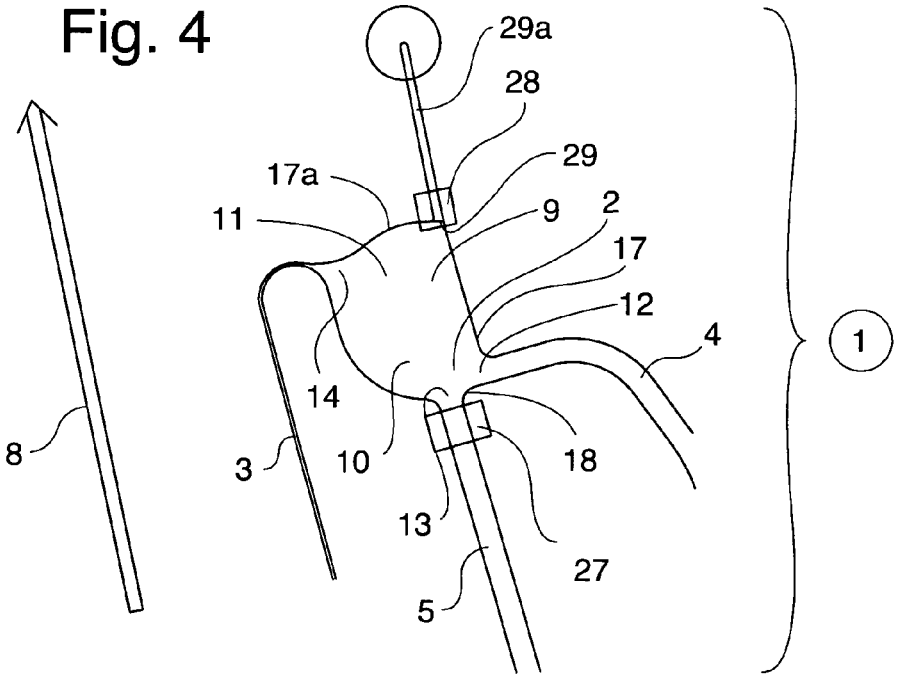
FIG. 4 shows a variant of a liquid router according to the invention.

A microfluidic device (7) with microchannel structures (6) as shown in FIGS. 1-3 was manufactured according to the same principles as outlined in WO 02975775 (Gyros AB) and GY 02775312 (Gyros AB). The lower substrate comprising the microchannel structures in uncovered form was $O_2$-plasma hydrophilized as outlined in the procedures given above and in WO 0056808 (Gyros AB). The open structures were covered by thermolaminating a lid as outlined in WO 0154810 (Gyros AB). Before covering the structures with a lid, the reduced apparent wettability of exit microconduit II (5) was introduced by applying non-wettable patches (27) on each inner sidewall of the exit microconduit II (5) next to exit II (13). One of these areas covered the surface (18) between exit I (12) and exit II (13). Non-wettable patches as vent functions (28,40), valve functions (37,38), and anti-wicking functions (39) were also introduced. Non-wettable patches (41,42,43) were also introduced on top of the lid at inlet ports (35,44) and outlets (44) to control undesired spreading of liquid. The lower side of the lid was hydrophobic suggesting that the top inner surface of the microchannel structure was non-wettable.

A defined volume of a suspension of streptavidin-coated beads (polystyrene-divinyl benzene beads, see PCT/SE2004/000440 was introduced through an inlet port (35) connected to the upstream reservoir (20). After metering outside the device, dispensing and transport of the suspension downstream in the microchannel structure (6), a packed nl-bed (21) was formed in the lower part of the upstream reservoir (20) connected to the inlet microconduit (3) of the liquid router (1). A suspension of reverse phase (RPC) beads were introduced into the lower inlet port (44), metered in a volume-metering microcavity (45) and transported further downstream into the downstream reservoir (30) by spinning. A reverse phase (RPC) nl-bed (33) was formed in the lower part of the downstream reservoir (30) that in the upstream direction is connected to exit microconduit II (5). Downstream the RPC-column was an open reservoir (32) in the form of detection microcavity (MALDI detection microcavity). See WO 02975775 (Gyros AB).

The streptavidin-coated beads/column were sensitized with an excess solution of biotinylated anti-HSA antibody (Human Serum Albumin) loaded into the upper inlet port (35) and passed through the streptavidin column by spinning. The spin speed was selected such that the liquid was directed through exit microconduit I (4) (1500 rpm, speed 1*a*).

Selective capture of HSA from a high protein content solution containing 1% ovalbumin and a lower amount of HSA was performed by loading an aliquot of the solution to the upper inlet port (35) and allowing the aliquot to pass through the sensitized columns (21) by spinning the device. The spin speed was selected such that the solution after capturing was directed through exit microconduit I (4) (1500 rpm, speed 1*a*) for each microchannel structure (6). Captured HSA was washed using a phosphate buffered saline solution (15 mM phosphate, 1.5 M NaCl) loaded into the upper inlet port (35) followed by spinning. Again the spin speed was selected to direct liquid into exit microconduit I (5) (1500 rpm, speed 1*a*). Elution from the affinity capture column (21) was performed using a 10 mM glycine-HCl buffer at pH 1.5 (Biacore, Sweden). The spin speed was selected such that the eluate was directed into the RPC column (33), i.e. exit microconduit II (5) (2500 rpm Rpm, speed 1*b*). HSA became adsorbed to the RPC column (33). Next a solution containing 50 μg/ml of sequencing grade trypsin (Promega Technologies, Madison, Wis., USA) in 50 mM ambic buffer solution pH 7.8 containing 50% acetonitrile (ACN) was introduced into the structure via the lower inlet ports (44) and passed over the RPC column (33) at a slow rate by spinning to allow efficient digestion of captured HSA (spin speed 300 rpm). Digested peptides were eluted from the RPC columns (33) using a solution containing the MALDI matrix (1 mg/ml of HCCA in 50% ACN/water). Crystallization was performed in the small MALDI MS target areas (MALDI MS detection microcavity) (32) and the appropriate mass spectrum recorded. Compare WO 02075775 (Gyros AB).

This protocol was carried out in parallel on all microchannel structures (6) of one or more of the subgroups of a microfluidic device (7).

A solution of HSA labeled with Alexa 647 fluorophore (Molecular Probes, Palo Alto, Calif., USA) was introduced via the inlet port (35) of the upstream reservoir (20) for following the performance of the microchannel structures (6). Labeled HSA collected as it should in the upstream part of the sensitized bed (21). No detectable fluorescence remained in the bed (21) after elution with the desorbing buffer (low pH) (spin speed 1*b*). The fluorescence signal from the downstream RPC column was measured after elution of the upstream bed (21). The result showed that HSA was captured on this latter bed (33).

A database search of the peptide masses of the recorded mass spectrum gave a total of 7 identified HSA peptides and 5 peptides from ovalbumin.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

What is claimed is:

1. A liquid router that comprises an inlet microconduit that branches into a first exit microconduit and a second exit microconduit and is present in a microchannel structure of a microfluidic device which uses centrifugal force created by spinning the device around a spin axis for transporting a liquid, wherein said router comprises:

a microcavity being positioned between said inlet microconduit and said first exit microconduit and said second exit microconduit, said microcavity further having a lower part comprising a first exit opening and a second exit opening, and an upper part comprising an inlet opening to which the inlet microconduit is connected;

said first exit microconduit and said second exit microconduit being connected to said first exit opening and said second exit opening respectively, and said second exit microconduit comprises;

a non-wettable patch whereby said second exit microconduit has reduced hydrophilicity compared to said first exit microconduit, wherein said reduced hydrophilicity of said second exit microconduit results from the non-wettable patch on the inner surface of the second exit microconduit and between the inlet opening and the second exit opening, wherein the patch is capable of hindering liquid transport on said surface from the inlet opening to the second exit opening.

2. The router of claim 1, further comprising a vent opening in the upper part of the microcavity, wherein said vent opening is capable of counteracting development of sub-pressure in the upper part of the microcavity when liquid is transported by said centrifugal force and leaves the microcavity through the first exit opening.

3. The router of claim 2, wherein a non-wettable patch surrounds the vent opening.

4. The router of claim 1, wherein the inner surface of the microcavity between said first exit opening and second exit opening is non-wettable.

5. The router of claim 1, wherein the difference in radial position between the inlet opening and second exit opening or the upper end of the hydrophobic patterning associated with the hydrophilicity of second exit opening and second exit microconduit is in the range of about ≧25 μm to about ≧300 μm.

6. The router of claim 1, wherein the difference in radial position between the inlet opening and second exit opening or the upper end of the hydrophobic patterning associated with the hydrophilicity of second exit opening and second exit microconduit is in the range of about ≦1000 μm to about ≦400 μm.

7. The router of claim 1, wherein said microchannel structure comprises:

a) a first process microcavity in fluid communication with the inlet opening and positioned closer to the spin axis than the inlet opening, for processing a liquid aliquot containing one or more components to one or more other liquid aliquots which each contains a remaining amount of one, two or more of said one or more components, and/or one or more product components formed during the processing, and b) a second process microcavity in fluid communication with one of the outlet microconduits and positioned at a greater radial position relative to the spin axis than the outlet microconduit for processing at least one of said one or more other liquid aliquots.

8. The router of claim 7, wherein said first and second process microcavities are selected from the group consisting of separation microcavities comprising separation medium, affinity reactors comprising affinity reagents, detection microcavities comprising detectors, and combinations thereof.

9. The router of claim 1, further comprising two or more of said microchannel structures in the microfluidic device.

10. The router of claim 9, wherein the microfluidic device is disc-shaped with each microchannel structure being essentially planar with the disc plane and the spin axis is orthogonal or parallel to the disc plane.

11. The router of claim 9, wherein the microfluidic device is disc-shaped with an axis of symmetry that is orthogonal to the disc plane.

12. The router of claim 9, wherein the axis of symmetry and spin axis coincide.

* * * * *